United States Patent [19]

Räuchle et al.

[11] 4,363,708

[45] Dec. 14, 1982

[54] PROCESS FOR EXPOSING SILICON CRYSTALS ON THE SURFACE OF A COMPONENT OF AN ALUMINUM ALLOY OF HIGH SILICON CONTENT

[75] Inventors: Wilfried Räuchle, Ostfildern; Walter Preisendanz, Hardt; Leonhard Scholtissek, Stuttgart, all of Fed. Rep. of Germany

[73] Assignee: Daimler-Benz Aktiengesellschaft, Stuttgart, Fed. Rep. of Germany

[21] Appl. No.: 263,909

[22] Filed: May 15, 1981

[30] Foreign Application Priority Data

May 24, 1980 [DE] Fed. Rep. of Germany ..... 3020012

[51] Int. Cl.[3] ..... C25F 3/04

[52] U.S. Cl. ..... 204/129.75; 204/129.8

[58] Field of Search ..... 204/129.75, 129.8

[56] References Cited

U.S. PATENT DOCUMENTS

| | | | |
|---|---|---|---|
| 3,085,950 | 4/1963 | Thomas | 204/129.75 |
| 3,230,160 | 1/1966 | Kennedy | 204/129.95 |
| 3,565,771 | 2/1971 | Gulla | 204/33 |
| 4,166,776 | 9/1979 | Lefebvre | 204/25 |

FOREIGN PATENT DOCUMENTS

| | | | |
|---|---|---|---|
| 2521149 | 11/1976 | Fed. Rep. of Germany | 204/129.46 |

*Primary Examiner*—T. Tufariello

*Attorney, Agent, or Firm*—Paul M. Craig, Jr.

[57] ABSTRACT

A process for exposing silicon crystals on the surface of an aluminum alloy of high silicon content and with undissolved silicon particles, wherein the aluminum alloy is connected as the cathode in an electrolyte containing an aqueous alkali nitrate solution which is at least 0.01 molar with respect to the nitrate ions and is subjected to electrolysis with a minimum current density of 0.5 $A/dm^2$ to remove aluminum from the alloy surface without removing silicon crystals. The electrolyte can also contain at least 0.005 mol/l fluoride ions and 0.05 mol/l–14 mol/l nitrite ions to suppress generation of hydrogen at the cathode and oxygen at the anode, respectively.

35 Claims, No Drawings

PROCESS FOR EXPOSING SILICON CRYSTALS ON THE SURFACE OF A COMPONENT OF AN ALUMINUM ALLOY OF HIGH SILICON CONTENT

The invention relates to a process for exposing the silicon crystals at the surface of an aluminum alloy of high silicon content and with undissolved silicon particles, by removing the aluminum on the alloy surface. The invention relates especially to a process for the surface treatment of components, particularly to frictionally stressed structural parts made of alloys based on aluminum with a high silicon content, especially cylinders of internal combustion engines.

Due to their low weight and good thermal properties, aluminum alloys have found increasing acceptance in automobile engine construction; in particular, cast alloys having a high silicon content and undissolved silicon particles are used in this connection. Such alloys contain, besides aluminum, about 6–20% by weight of Si and, in some cases, additionally about 3–11% by weight of Cu or about 7–9% by weight of Mg. The so-called hypereutectic alloys are utilized especially frequently for engine blocks, which are based on aluminum with for example, about 16–18% by weight of Si, about 4.2–4.9% by weight of Cu and minor amounts of other elements, such as, for example, 0.45–0.65% by weight of Mg, 0.08–0.2% by weight of Ti, up to 1% by weight of Fe, and optionally up to about 0.1% by weight of Mn.

Since aluminum tends to seize under sliding friction, the aluminum is customarily removed from the respective surface so that silicon crystals project from the aluminum alloy surface. The sliding surface proper is thus constituted by silicon, and the aluminum with its seizing tendency is located at a deeper level.

The exposure of the silicon crystals on the surface has heretofore been effected by a special honing procedure producing a kind of textured polishing which, however, is not very suitable for series production, for reasons of manufacturing technology.

Furthermore, aluminum has been removed from the surface by chemical etching. In this connection, use was made of acidic baths of nitric acid-hydrofluoric acid mixtures or phosphoric acid-nitric acid mixtures, for example, 60–90 vol-% $H_3PO_4$ (85% strength), 5–15 vol-% $HNO_3$ (70% strength), remainder water up to 15 vol-%, as well as alkaline baths with an aqueous solution containing about 2–6% by weight of NaOH. The disadvantages in these chemical etching processes are the poor controllability of the etching attack, especially in case of exposure depths on the order of 1 $\mu$m; the pitting-like attack when the etching agent is exhausted; as well as the corrosive attack after the etching procedure proper. The dissolution of the aluminum is effected, more frequently than with chemical etching, by the use of electric current, wherein the aluminum is connected as the anode into an electrical circuit with a neutral electrolyte. However, if aluminum is connected as the anode in an electrolyte, then a protective passive layer is formed (anodizing). In case of high anodic load, the thus-formed passive layer can be locally destroyed, resulting in localized corrosion (pitting); a uniform exposure of the silicon crystals on the surface is not accomplished. This pitting-like attack, although providing improved lubrication by the formation of oil pockets, does not result in a uniform setback of the aluminum matrix. The characteristics in use as a structural part of an engine of such treated alloy based on aluminum are satisfactory as long as a setback of the aluminum matrix by a textured polishing effect is still in existence due to the honing procedure. In honing processes wherein, on account of a good cutting effect of the honing stones, aluminum and silicon lie practically in one plane seizing can occur in spite of the oil pockets. Copper-containing aluminum alloys, as is the case practically always in the aluminum alloys of high silicon content, are additionally attacked with pitting under selective dissolution of the actually desirable, hard intermetallic phases.

Therefore, it is an object of the invention to find a process which makes it possible to uniformly expose all silicon crystals on the surface of an aluminum alloy of high silicon content and with undissolved silicon particles and wherein an especially uniform removal of the aluminum is accomplished.

Moreover, it is an object of the invention to provide a process wherein silicon crystals are exposed on the surface of such an aluminum alloy, which process can be used in engine construction, particularly automobile engine construction, to expose silicon crystals on the surface of engine components made of the alloy.

Moreover, it is a further object of the invention to provide a process wherein silicon crystals are exposed on the surface of such an aluminum alloy, which process can be used in constructing frictionally stressed structural parts, especially cylinders of internal combustion engines, made of an alloy based on aluminum, which aluminum is subject to seizing under sliding friction.

Moreover, it is a further object of the invention to provide a process for treating aluminum alloys of high silicon content and with undissolved silicon particles, which alloys also contain desirable, hard intermetallic phases, wherein the desirable, hard intermetallic phases are not removed when exposing the silicon on the alloy surface and removing aluminum from the alloy surface.

Moreover, it is a further object of the invention to provide a process for treating a structural component formed of such an aluminum alloy, and the structural component so treated, wherein the silicon is exposed on the surface of the structural component, whereby problems of seizing of the structural component due to the tendency of aluminum to seize under sliding friction is overcome.

The foregoing objects are accomplished by the process wherein a component of an aluminum alloy of high silicon content and with undissolved silicon particles is connected as the cathode and is subjected to an electrolysis with a minimum current density of 0.5 A/dm$^2$ in an electrolyte containing an aqueous alkali nitrate solution which is at least 0.01 molar with respect to the nitrate ions. Preferably, the current density during the electrolysis is 1–18 A/dm$^2$, most preferably 3–12 A/dm$^2$. Moreover, preferably the aqueous alkali nitrate solution is a 0.3–6 molar aqueous alkali nitrate solution, more preferably a 1–5 molar solution, and the electrolyte has a pH of 1–12, more preferably 5–10. In addition, the electrolyte preferably has a conductivity of at least 2000 mmho/m, and if such aqueous alkali nitrate solution does not provide sufficient conductivity, the electrolyte can also include a neutral conductive salt with an alkali cation to increase conductivity. The electrolyte can, in addition, include at least 0.005 mol/l, preferably 0.005–0.8 mol/l, most preferably 0.025–0.05 mol/l, fluoride ions, and/or 0.05–14 mol/l nitrite ions. If the electrolyte includes nitrite ions, it is preferred that such ions are included in a concentration of 0.2–0.6 times the nitrate concentration but at least 0.05 mol/l, as stated previously.

It is extraordinarily surprising and could not be foreseen that, according to the process of this invention, the aluminum is dissolved although connected as the cathode. The electrolyte is an aqueous alkali nitrate solution which is at least 0.01-molar with respect to the nitrate ions. If the electrolyte contains less than 0.01 mole of nitrate ions per liter, then $H_2$-formation is observed even after an induction period (see infra for a description of this induction period), and the attack becomes nonuniform. The upper limit of the concentration is determined by the solubility of the respective nitrates. Preferably, an electrolyte concentration is chosen which lies below the maximally dissoluble amount of nitrate, to avoid difficulties with the crystallization of the nitrate salts in the electrolyte during supersaturation of the solution on account of water losses by evaporation. Preferred nitrates are the alkali nitrates, preferably in a concentration of 0.3–6 moles per liter, especially potassium and sodium nitrate in a concentration of 1–5 moles per liter.

The electrolysis is to be conducted with a minimum current density of 0.5 $A/dm^2$ at the cathode. Below such a current density, the attack is not always uniform, i.e., at some locations the aluminum will be dissolved whereas at other locations the aluminum will not be dissolved, which supposedly is due to a different thickness of the passive layer; this has been determined by experiments with differently pretreated specimens (grinding, polishing, chemical reinforcement of the natural oxide layer). With rising current density, uniform attack occurs initially which is proportional to the amperage. Above a current density of 24 $A/dm^2$, however, the current efficiency is reduced; additionally, excessive gas evolution can occur at the anode. If the gas evolution is not a disturbing factor, then high current densities of up to 100 $A/dm^2$ and more can be utilized. A range from 1 to 18 $A/dm^2$, especially from 3 to 12 $A/dm^2$, is preferred for the current density, since in the range from 1 to 18 $A/dm^2$ uniform etching takes place relatively independently of the pretreatment, such as mechanical machining and washing processes. In the range from 3 to 12 $A/dm^2$, especially favorable treatment times are obtained from the viewpoint of manufacturing technology, particularly with a desired exposure depth on the order of 1 $\mu m$. In theory, any desired exposure depth is attainable, however, in practice, values of 0.3 to 2 $\mu m$, more specifically, 0.5 to 1.5 $\mu m$ are preferable.

The electrolyte is usable over a wide temperature range, so that generally there is no need for separate heating or cooling devices for the electrolyte. Preferably, the electrolysis is conducted at room temperature or at the slightly elevated temperature occurring due to the current flow.

Since the electrolyte consists of an aqueous nitrate solution, it generally shows a neutral reaction. During operation, the electrolyte then gradually becomes alkaline. A pH of 12 should not be exceeded; the process will still be functional in such a case, but the electrochemical removal process will then be increasingly overshadowed by a chemical etching process, with the ensuing disadvantages. However, an excess amount of alkali can readily be eliminated by adding nitric acid. An overdosing with nitric acid is harmless in such a case, since the process still operates satisfactorily even in a strongly acidic range (e.g., down to a pH of 1). However, the aluminum is again chemically attacked at below pH 4, which is undesirable per se. Since nitrite ions are also formed during the course of the electrolysis, though, it is preferred in practical operation to use an electrolyte which is at most extremely weakly acidic, more desirably neutral or slightly alkaline. Especially favorable results with regard to the uniformity of removing the aluminum are obtained in the range of pH 5–10.

If an aluminum component is subjected to the process of this invention, then it is determined that the dissolution of the aluminum begins only after a certain induction period. This induction period lasts generally 20–120 seconds and depends in part on the pretreatment of the aluminum (cleaning etc.). The induction period can be recognized by a gas evolution at the cathode. After cessation of the gas formation, the aluminum dissolution, i.e., the exposure of the silicon crystals, begins. The dissolution of the aluminum takes place entirely uniformly and is approximately proportional to the treatment period, calculated from the end of the gas evolution. Thus, for example, an aluminum layer having a thickness of 0.5 $\mu m$ is dissolved in about 15 seconds in an electrolyte containing 400 g of $NaNO_3$ per liter (i.e., which is 4.7-molar) at a current density of 6 $A/dm^2$ and with a pH value of between 7 and 9. Besides observing the end of the induction period purely optically by looking at the gas formation, this point in time can also be recognized electrochemically. It has been found that the difference of potential between the aluminum workpiece and a reference electrode, e.g. a calomel electrode, is suitable for this purpose. When using a calomel electrode as the reference electrode, it is determined, for example, that a potential difference between the aluminum workpiece and the reference electrode of 1.850 mV exists at the beginning of the induction period. As soon as the difference in potential has dropped to 1.450 mV (this value corresponds simultaneously to the maximum of the second derivative of the potential-time curves), gas formation ceases and removal of the aluminum begins. Since with constant amperage and the same aluminum alloy, the difference in potential between the aluminum workpiece and a reference electrode at the end of the hydrogen evolution (end of induction period) is practically constant, i.e., independent of the pH value, the end of the induction period can thereby be readily determined with the aid of simple, conventional electric circuits; consequently, an automatic control of the process becomes possible in a simple way. It is merely necessary for this purpose to determine only once, at the beginning of a production series, the difference in potential corresponding to the end of the induction period, or to continuously determine, by double electronic differentiation of the potential difference-time curve, the end of the induction period recognizable by reaching the maximum of the derivation, and then to effect, subsequently to the induction period, the removal process for the desired period of time corresponding to the removal depth. Since the cell voltage, amounting to about 2.5–10 volts, depending on the concentration of the electrolyte and on the anode/cathode surface area ratios, differs from the potential difference of calomel-electrode/aluminum cathode only by a value which also depends on the anode material, it is possible to omit the calomel electrode, in principle, especially if the maximum of the second derivative of the cell voltage according to the time is utilized for determining the end of the induction period.

For reasons of manufacturing technology, the hydrogen evolution at the cathode during the induction period, as well as the formation of oxygen at the anode, can have a very disturbing effect, especially in case of V-8 engines, if both cylinder rows are to be etched simultaneously, i.e., with an inclined positioning of the cylinders. With an induction period of 40 seconds, a total treatment period of 60 seconds, and an amperage of 6 $A/dm^2$, about 50 $cm^3$ of gas is formed per cylinder, which leads in case of obliquely positioned cylinders to a nonuniform attack due to gas accumulations.

The hydrogen evolution is supposedly a consequence of inhibition of nitrate reduction on the passive oxide of the aluminum. It has been found surprisingly that this inhibition can be extensively suppressed by adding fluoride ions on the order of about at least 0.005 mole/liter at a current density of 0.5 $A/dm^2$. With a current density of 24 $A/dm^2$, about at least 0.015 mole/liter of fluoride ions are required. No chemical etching attack is evoked by the fluoride ions even in weakly acidic as well as in alkaline solutions.

Since the aluminum, precipitating in gel form while conducting the process, apparently entrains fluoride ions, substantially higher fluoride ion concentrations will be preferred. It is possible to use solutions saturated in fluoride ions. However, concentrations of 0.025–0.05 mole per liter of $F^-$ are preferred, which already lies close to saturation in electrolytes based on $Na^+$ cations. In case of electrolytes on the basis of $K^+$ cations, higher fluoride concentrations would even be possible, but this is avoided for reasons of environmental protection (fluoride enrichment in the washing water). In specimens subjected to the same pretreatment, the induction period is reduced to about one-half by the fluoride addition. The dissolution rate of the aluminum after the induction period is decreased. Both factors in combination effect a uniform attack in case of aluminum components having a locally varying thickness of the natural oxide layer.

In general, an oxygen evolution occurs at the anode which may be troublesome in certain instances. This troublesome oxygen formation can be affected by the addition of nitrite ions. With a practically stationary electrolyte, the oxygen evolution, for example, on platinum anodes with an anode current density of 3 $A/dm^2$ can be suppressed by adding 0.05 mol/l of $NO_2^-$ ions, and with an anode current density of 12 $A/dm^2$, the oxygen evolution can be suppressed by adding 0.3 mol/l of $NO_2^-$ ions, both for about 20 seconds. Thereafter oxygen formation resumes, probably due to depletion of the anolyte in $NO_2^-$ ions. However, in a moderately agitated electrolyte, the oxygen formation remains suppressed at these concentrations. To permanently suppress oxygen formation even in a stationary electrolyte, approximately 5-fold the $NO_2^-$ ion concentrations to suppress oxygen evolution for 20 seconds is required.

By adding nitrite, the cathodic dissolution of the aluminum is somewhat inhibited. However, even if a pure nitrite solution (without the addition of nitrate ions) is used as the starting material, the aluminum will be etched cathodically after a short period of time, since due to the anodic oxidation of the nitrite to nitrate, a nitrate concentration of about 0.01 mol/l $NO_3^-$ ions is reached relatively quickly. Accordingly, the very broad range of 0.05 mol/l up to a saturated solution (14 mol/l when using $KNO_2$) results for the possible nitrite concentrations. With the preferred nitrate concentration of 1–5 mol/l $NO_3^-$ ions, an $NO_2^-$ concentration of 0.5–2.5 mol/l $NO_2^-$ ions is advantageous. In general, an $NO_2^-$ ion concentration corresponding to 0.2- to 0.6-times the $NO_3^-$ ion concentration is especially advantageous.

All electrodes not subject to dissolution can be utilized as the anode in the process of this invention; preferred are platinum, platinized titanium, and high-quality steels.

The oxygen formation on the anode can be practically entirely suppressed by nitrite ion addition when using platinum anodes, at the preferred current densities; this cannot be accomplished in case of anodes made of high-quality steel. However, the addition of nitrite ions is of advantage even in case of high-quality steel anodes, since the attack on the high-quality steel anodes, especially pitting, which is still noticeable in case of a nitrite-free electrolyte, is thereby prevented; this is also due to a reduction in the cell voltage.

In order to avoid inordinately high voltages for reaching the required minimum current density, the electrolyte should have a minimum conductivity of 2000 mmho/m. If this conductivity cannot be attained due to ion concentrations which are too low, then one of the conventional neutral conductive salts with alkali cation can be added to raise conductivity, for example, sodium sulfate. However, it is more expedient in general to produce sufficient conductivity by maintaining a corresponding concentration of salts used anyway in the electrolyte.

The process of this invention achieves for the first time in a neutral electrolyte the desired removal of the aluminum surface which tends to seize, this removal being entirely uniform over the entire surface treated. As a working surface, the silicon crystals remain, along with the hard intermetallic phases which heretofore were removed with the aluminum. The electrolyte remains usable without changing over a long period of time, since the removed aluminum is precipitated as a hydroxide and the remaining metals contained in the aluminum alloy, such as copper, are not converted into ions due to the high electron pressure at the cathode (cathodic protection). It may be necessary in some cases to keep the concentrations and the pH value within the limits of this invention by subsequent metered feed of solution components.

While we have shown and described preferred embodiments in accordance with the present invention, it is understood that the same is not limited thereto but is susceptible of numerous changes and modifications as known to one having ordinary skill in the art and we therefore do not wish to be limited to the details shown and described herein, but intend to cover all such modifications as are encompassed by the scope of the appended claims.

We claim:

1. Process for exposing the silicon crystals on the surface of a component of an aluminum alloy containing 6–20% by weight of silicon and with undissolved silicon particles, by removing aluminum on the alloy surface with the use of electric current, characterized in that the surface is connected as the cathode and is subjected to an electrolysis with a minimum current density of 0.5 $A/dm^2$ in an electrolyte containing an aqueous alkali nitrate solution which is at least 0.01-molar with respect to the nitrate ions.

2. Process according to claim 1, characterized by using a 0.3- to 6-molar aqueous alkali nitrate solution.

3. Process according to claim 2, characterized by using a 1–5 molar aqueous alkali nitrate solution.

4. Process according to claim 1, 2, or 3, characterized by using a current density of 1–18 A/dm$^2$ at the cathode.

5. Process according to claim 4, characterized by using a current density of 3–12 A/dm$^2$.

6. Process according to claim 4, characterized in that the electrolyte contains 0.005 mol/l to 0.8 mol/l of fluoride ions.

7. Process according to claim 4, characterized in that the conductivity of the electrolyte is set to at least 2000 mmho/m.

8. Process according to claim 4, characterized in that the electrolyte contains 0.05 mol/l to 14 mol/l of nitrite ions.

9. Process according to claim 8, characterized in that the electrolyte also contains 0.005 mol/l to 0.8 mol/l of fluoride ions.

10. Process according to claim 4, characterized in that the electrolyte has a pH value of 1–12.

11. Process according to claim 10, characterized in that the electrolyte contains 0.005 mol/l to 0.8 mol/l of fluoride ions.

12. Process according to claim 11, characterized in that the conductivity of the electrolyte is set to at least 2000 mmho/m.

13. Process according to claim 12, characterized in that the electrolyte contains 0.05 mol/l to 14 mol/l of nitrite ions.

14. Process according to claim 1, 2, or 3, characterized in that the electrolyte has a pH value of 1–12.

15. Process according to claim 14, characterized in that the electrolyte has a pH value of 5–10.

16. Process according to claim 14, characterized in that the electrolyte contains 0.005 mol/l to 0.8 mol/l of fluoride ions.

17. Process according to claim 14, characterized in that the conductivity of the electrolyte is set to at least 2000 mmho/m.

18. Process according to claim 14, characterized in that the electrolyte contains 0.05 mol/l to 14 mol/l of nitrite ions.

19. Process according to claim 18, characterized in that the electrolyte also contains 0.005 mol/l to 0.8 mol/l of fluoride ions.

20. Process according to claim 1, 2, or 3, characterized in that the electrolyte contains 0.005 mol/l to 0.8 mol/l of fluoride ions.

21. Process according to claim 20, characterized in that the electrolyte contains 0.025–0.05 mol/l of fluoride ions.

22. Process according to claim 20, characterized in that the conductivity of the electrolyte is set to at least 2000 mmho/m.

23. Process according to claim 20, characterized in that the electrolyte contains 0.05 mol/l to 14 mol/l of nitrite ions.

24. Process according to claim 23, characterized in that the electrolyte contains 0.025 mol/l to 0.05 mol/l of fluoride ions.

25. Process according to claim 1, 2, or 3, characterized in that the conductivity of the electrolyte is set to at least 2000 mmho/m.

26. Process according to claim 25, characterized in that a neutral conductive salt with an alkali cation is added to the electrolyte to increase conductivity.

27. Process according to claim 25, characterized in that the electrolyte contains 0.05 mol/l to 14 mol/l of nitrite ions.

28. Process according to claim 27, characterized in that the electrolyte also contains 0.005 mol/l to 0.8 mol/l of fluoride ions.

29. Process according to claim 1, 2, or 3, characterized in that the electrolyte contains 0.05 mol/l to 14 mol/l of nitrite ions.

30. Process according to claim 29, characterized in that an anode of platinum is utilized during said electrolysis.

31. Process according to claim 29, characterized in that the nitrite concentration amounts to 0.2- to 0.6-times the nitrate concentration, but at least is 0.05 mol/l.

32. Process according to claim 1, characterized in that said alloy also contains 3–11% by weight of Cu or 7–9% by weight of Mg.

33. Process according to claim 1, characterized in that said aluminum alloy contains 16–18% by weight of Si, 4.2–4.9% by weight of Cu, 0.45–0.65% by weight of Mg, 0.08–0.2% by weight of Ti, 0–1% by weight of Fe, and 0–0.1% by weight of Mn.

34. Product formed by the process of claim 1, 32 or 33.

35. Process according to claim 1, characterized in that the alkali metal nitrate solution is a sodium or potassium nitrate solution.

* * * * *